US008238765B2

(12) United States Patent
Naoi et al.

(10) Patent No.: US 8,238,765 B2
(45) Date of Patent: Aug. 7, 2012

(54) FITTING STRUCTURE FOR PROCESS CARTRIDGES AND IMAGE FORMING APPARATUS BODY, AND IMAGE FORMING APPARATUS HAVING THIS STRUCTURE

(75) Inventors: Shinya Naoi, Toyokawa (JP); Takeshi Hashimoto, Okazaki (JP); Koji Soda, Toyokawa (JP); Michiya Takeda, Toyokawa (JP); Taiichi Ominami, Chiryu (JP); Akira Matsue, Toyokawa (JP)

(73) Assignee: Konica Minolta Business Technologies, Inc., Chiyoda-ku, Tokyo (JP)

( * ) Notice: Subject to any disclaimer, the term of this patent is extended or adjusted under 35 U.S.C. 154(b) by 162 days.

(21) Appl. No.: 12/825,690

(22) Filed: Jun. 29, 2010

(65) Prior Publication Data

US 2010/0329731 A1 Dec. 30, 2010

(30) Foreign Application Priority Data

Jun. 30, 2009 (JP) ..... 2009-155345

(51) Int. Cl.
*G03G 15/01* (2006.01)
*G03G 21/18* (2006.01)

(52) U.S. Cl. ..... 399/12; 399/112

(58) Field of Classification Search ..... 399/12, 399/110, 111, 112, 262
See application file for complete search history.

(56) References Cited

U.S. PATENT DOCUMENTS 6,023,594 A * 2/2000 Okiyama et al. ..... 399/12
6,505,006 B1 1/2003 Solanki et al.
7,551,860 B2 6/2009 Kawai
2005/0111858 A1 5/2005 Nakazato

FOREIGN PATENT DOCUMENTS

EP 1 923 753 A2 5/2008
JP 2003-84534 A 3/2003

OTHER PUBLICATIONS

Extended Search Report issued on Oct. 14, 2010 by the European Patent Office in corresponding European Patent Application No. 10167883.7—2209.

* cited by examiner

*Primary Examiner* — Sophia S Chen

(74) *Attorney, Agent, or Firm* — Buchanan Ingersoll & Rooney PC

(57) ABSTRACT

A fitting structure for process cartridges and an image forming apparatus body of an image forming apparatus capable of fitting the process cartridges for plural colors thereto, the fitting structure including: an incompatible member with its cross-sectional shape in an axial direction being rotationally symmetrical, the incompatible member having at least one attaching projection and one displaying hole or one displaying notched portion formed on a position different from a rotational shaft of the rotationally symmetrical shape; an attached portion of the process cartridge capable of holding the incompatible member, having identification display portions for identifying the plural colors arranged on the position corresponding to the displaying hole or the displaying notched portion; and an acceptance portion of the image forming apparatus body having an acceptance concave portion for accepting the at least one attaching projection of the incompatible member.

16 Claims, 10 Drawing Sheets

FITTING STRUCTURE FOR PROCESS CARTRIDGES AND IMAGE FORMING APPARATUS BODY, AND IMAGE FORMING APPARATUS HAVING THIS STRUCTURE

This application is based on application No. 2009-155345 filed in Japan on Jun. 30, 2009, the contents of which are hereby incorporated by reference.

BACKGROUND OF THE INVENTION

1. Field of the Invention

The present invention relates to a fitting structure for process cartridges and an image forming apparatus body, and an image forming apparatus having this structure.

2. Description of Related Art

Conventionally, in an image forming apparatus for fitting process cartridges of plural colors into the image forming apparatus body, it is necessary to prevent a process cartridge of a specific color from being fit to other place than a predetermined position.

According to an image forming apparatus disclosed in Japanese Unexamined Patent Publication No. 2003-84534, process cartridges of respective colors are provided with incompatible keys on different positions on side plates thereof, and a guide rail for guiding each of the process cartridges to a fitting position of the image forming apparatus is provided with a concave portion to only accept the incompatible key of the predetermined process cartridge. Due to the engagement between the incompatible key and the concave portion, it is possible to certainly fit each of the process cartridges to the predetermined position of the apparatus body.

However, according to the above-described image forming apparatus, since it is necessary that the process cartridges are provided with the side plates with the different shapes corresponding to a plurality of colors and the concave portions corresponding to these side plates are provided to respective guide rails. Therefore, its manufacturing cost increases. In addition, this apparatus has another problem that the color of the toner of the process cartridge cannot be identified since the incompatible key is not given an identification information of the color of the toner.

SUMMARY OF THE INVENTION

A fitting structure for process cartridges and an image forming apparatus body according to one aspect of the present invention is a fitting structure for process cartridges and an image forming apparatus body of an image forming apparatus capable of fitting the process cartridges for plural colors thereto, the fitting structure including:

an incompatible member with its cross-sectional shape in an axial direction being rotationally symmetrical, the incompatible member having at least one attaching projection and one displaying hole or one displaying notched portion formed on a position different from a rotational shaft of the rotationally symmetrical shape;

an attached portion of the process cartridge capable of holding the incompatible member with the at least one attaching projection being protruded to the side toward the image forming apparatus body at plural postures being rotated around the rotational shaft, the attached portion having identification display portions for identifying the plural colors arranged on the position corresponding to the displaying hole or the displaying notched portion for each of the plural postures; and an acceptance portion of the image forming apparatus body having an acceptance concave portion for accepting the at least one attaching projection of the incompatible member.

A fitting structure for process cartridges and an image forming apparatus body according to another aspect of the present invention is a fitting structure for process cartridges and an image forming apparatus body of an image forming apparatus capable of fitting the process cartridges for plural colors thereto, the fitting structure including:

an incompatible member with its cross-sectional shape in an axial direction being rotationally symmetrical, the incompatible member having at least one attaching hole or at least one attaching notched portion and one displaying hole or one displaying notched portion formed on a position different from a rotational shaft of the rotationally symmetrical shape;

an attached portion of the process cartridge capable of holding the incompatible member at plural postures being rotated around the rotational shaft, the attached portion having identification display portions for identifying the plural colors arranged on the position corresponding to the displaying hole or the displaying notched portion for each of the plural postures; and an acceptance portion of the image forming apparatus body having an insertion convex portion to be inserted into the at least one attaching hole or the at least one attaching notched portion of the incompatible member.

DETAILED DESCRIPTION OF THE PREFERRED EMBODIMENTS

Hereinafter, the embodiments of the present invention will be described with reference to the drawings.

Figure 1:
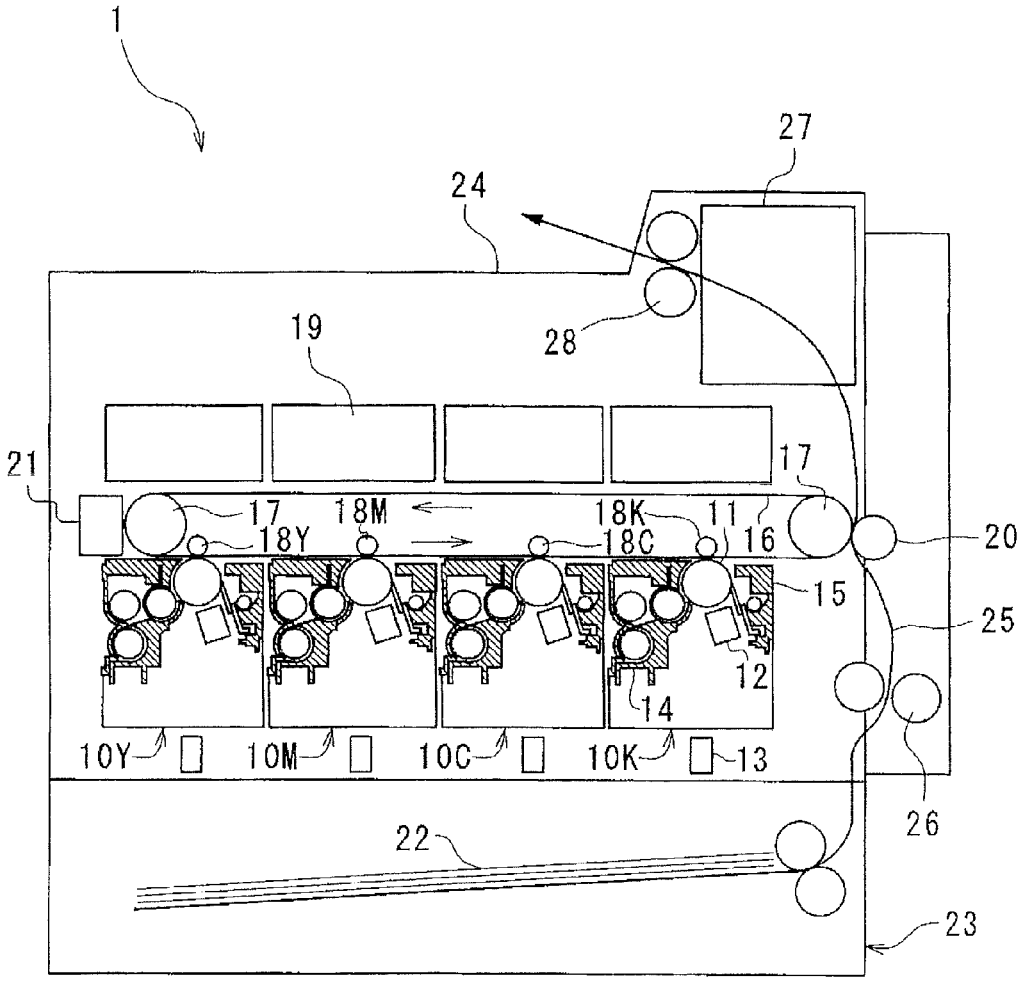
FIG. 1 is a schematic view showing an image forming apparatus.

FIG. 1 is a schematic view of a common tandem type of full color electro photographic image forming apparatus, to which the present invention is applied.

In an image forming apparatus 1, four process cartridges 10Y, 10M, 10C, and 10K for Yellow (Y), Magenta (M), Cyan (C), and Black (K) are arranged.

Each process cartridges 10Y, 10M, 10C, and 10K is provided with a charging device 12, a developing device 14, and a cleaning device 15 around a photoconductor drum (an image carrying member) 11. In addition, an image forming apparatus body 2 is provided with an image exposure device 13. Over the process cartridges 10Y, 10M, 10C, and 10K, an intermediate transfer belt 16 is bridged across a pair of rollers 17 so as to be cyclically moved in a direction of arrow by a driving unit (not illustrated). Inside of the intermediate transfer belt 16, primary transfer devices 18Y, 18M, 18C, and 18K are provided so as to be opposed to the photoconductor drums 11. Outside of the intermediate transfer belt 16, a secondary transfer device 20 being opposed to one roller 17 and a transfer belt cleaning device 21 being opposed to other roller 17 are provided. Further, below the process cartridges 10Y, 10M, 10C, and 10K, a sheet cassette 23 containing recording paper (a recording medium) 22 is provided. A recording medium conveying path 25 is formed ranged from the sheet cassette 23 to a discharge tray 24 placed on the upper surface of the image forming apparatus 1 via the secondary transfer device 20. On the recording medium conveying path 25 between the sheet cassette 23 and the secondary transfer device 20, a conveyance roller 26 is disposed. On the recording medium conveying path 25 between the secondary transfer device 20 and the discharge tray 24, a fixing device 27 is disposed, and on the side of the fixing device 27 toward the discharge tray 24, a discharge roller 28 is disposed. Above the process cartridges 10Y, 10M, 10C, and 10K, toner boxes 19 are attached. On the front side of the drawing of the process cartridges 10Y, 10M, 10C, and 10K, a waste powder collecting device (not illustrated) is attached.

In the process cartridge 10K, the charging device 12 uniformly charges the surface of the photoconductor drum 11 to a desired potential, the image exposure device 13 irradiates the surface of the photoconductor drum 11 with a light based on the image data to form an electrostatic latent image. By supplying toners from the developing device 14 to the photoconductor drum 11 having the electrostatic latent image formed thereon, the electrostatic latent image is developed to form a toner image on the photoconductor drum 11. In the same way, the toner images are also formed on each of other process cartridges 10Y, 10M, and 10C. Each of the developed toner images is sequentially transferred to the intermediate transfer belt 16 by primary transfer devices 18Y, 18M, 18C, and 18K. Four-color toner images superimposed on each other are collectively transferred from the intermediate transfer belt 16 by means of the secondary transfer device 20 to a recording paper 22 which is conveyed by the conveyance roller 26 from the sheet cassette 23. After the toner image transferred to the recording paper 22 is fixed by the fixing device 27, the recording paper 22 is discharged to the discharge tray 24 by the discharge rollers 28.

The toners that are not transferred by the primary transfer device 18 and remain on respective photoconductor drums 11Y, 11M, 11C, and 11K are swept away by cleaning devices 15Y, 15M, 15C, and 15K each including a cleaning blade. The toners that are not transferred by the secondary transfer device 20 and remain on the intermediate transfer belt 16 are swept away by the transfer belt cleaning device 21 including a cleaning blade. The toners swept away by the cleaning device 15Y, 15M, 15C, and 15K, and the transfer belt cleaning device 21 are collected by the waste powder collecting device (not illustrated), respectively.

Figure 2:
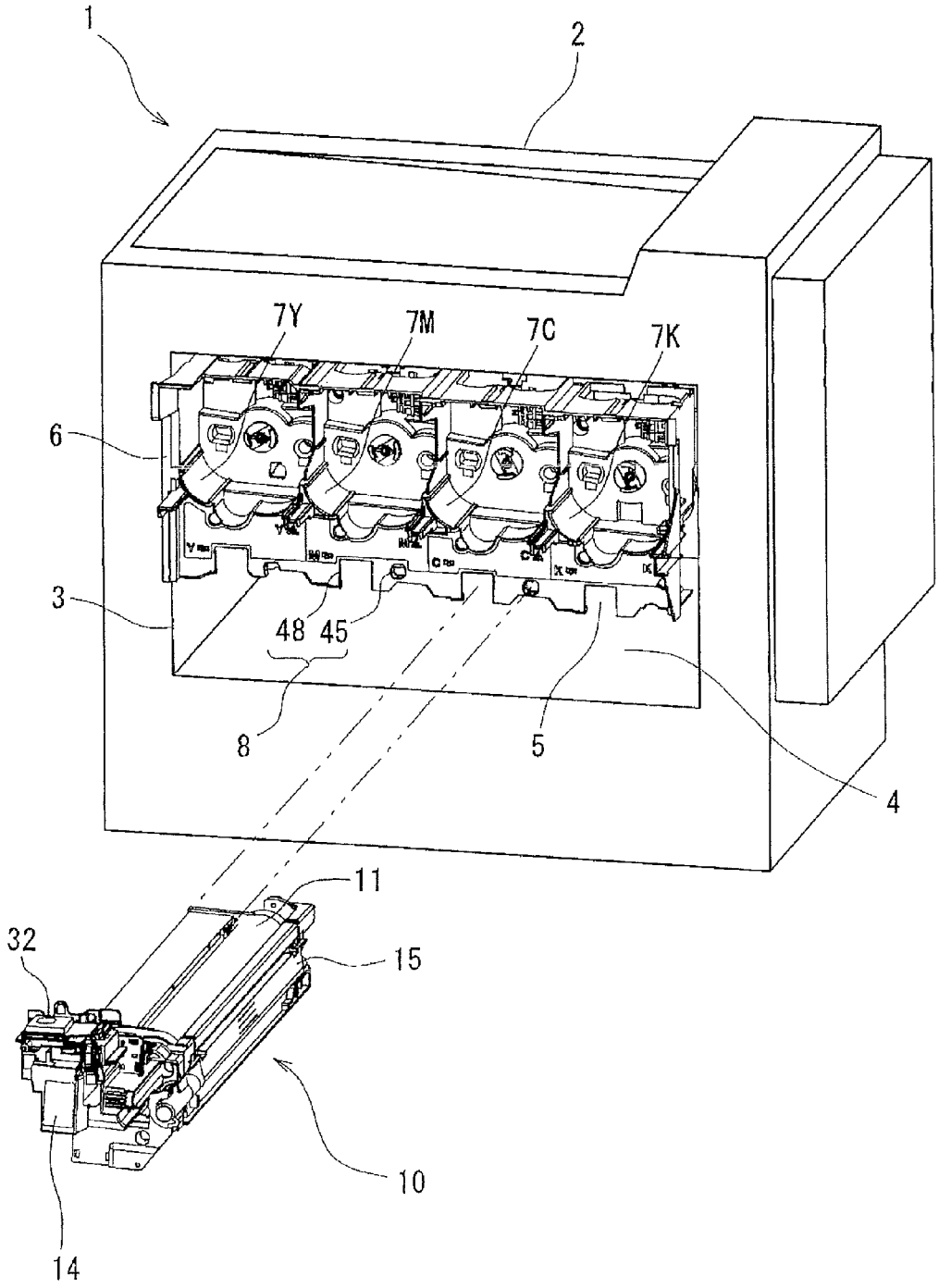
FIG. 2 is a view showing a process cartridge and an image forming apparatus body.

FIG. 2 shows the process cartridges 10Y, 10M, 10C, and 10K (in the drawing, one process cartridge is denoted by a reference numeral 10), and the image forming apparatus body 2 to which these process cartridges 10 are fitted. The image forming apparatus body 2 is provided with an acceptance portion 3 to accept the process cartridge 10.

Figure 3:
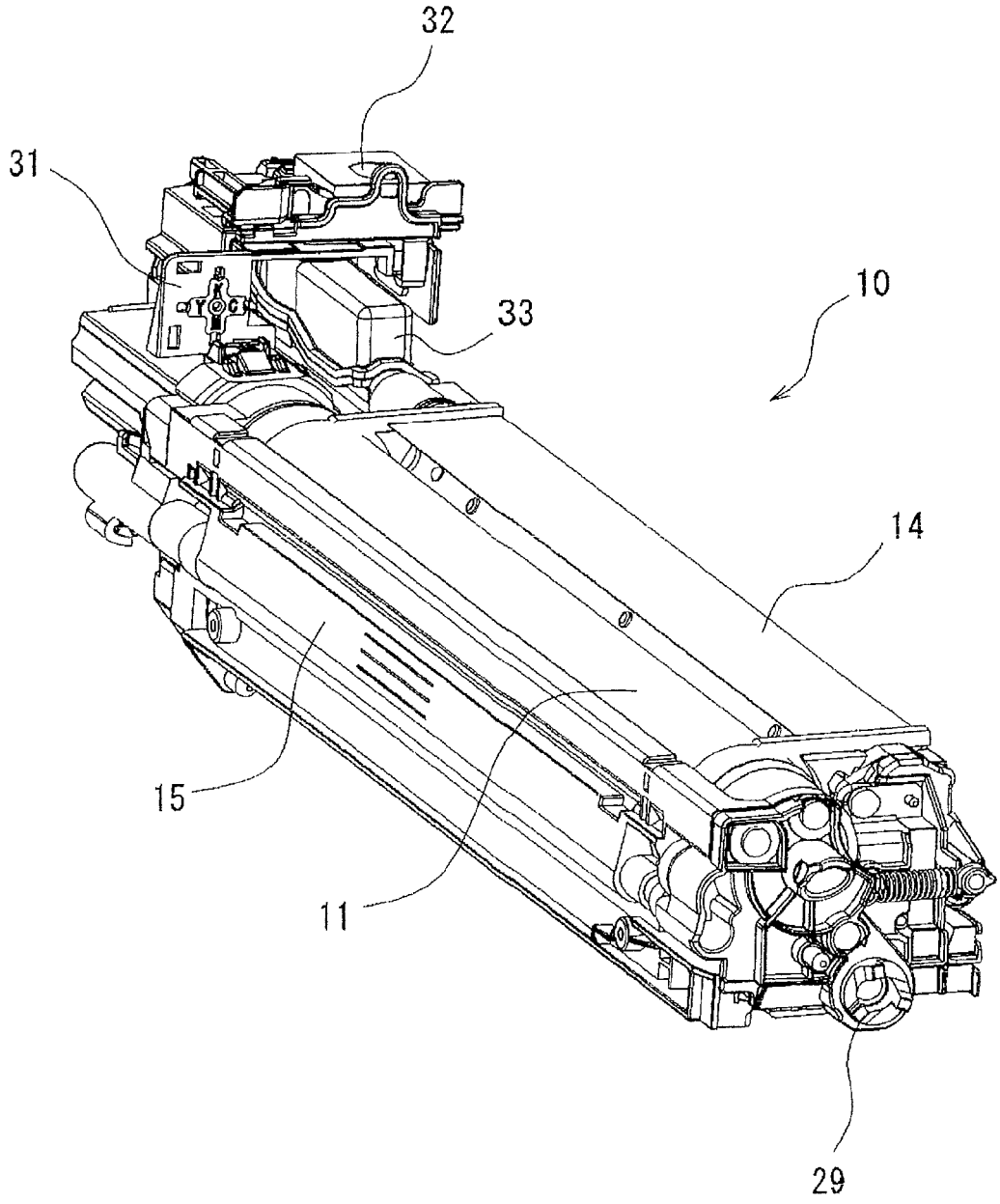
FIG. 3 is a perspective view of the process cartridge.

FIG. 3 is a perspective view of the process cartridge 10 as seen from the front end side in an insertion direction into the image forming device body 2. The process cartridge 10 is formed in an approximately rectangular-parallelepiped shape with the axial direction of the rotational shaft of the photoconductor drum 11 as a longitudinal direction. In the process cartridge 10, the photoconductor drum 11, the charging device 12, the developing device 14, and the cleaning device 15 are integrated.

On the front end side in the direction that the process cartridge 10 is inserted into the image forming device body 2, a front end side engaging portion 29 is placed. The front end side engaging portion 29 is adapted to be engaged to the front end side engaged portion (not illustrated) that is placed in a back side in the above-described insertion direction of the acceptance portion 3 of the image forming device body 2.

On the rear end side in the direction that the process cartridge 10 is inserted into the image forming device body 2, an attached portion 31 for attaching an incompatible member 30 (to be described later) is displaced on the side toward the photoconductor drum 11, and a toner supply hole 32 and a developing device side engaging portion 33 are displaced on the side toward the developing device 14.

Figure 4:
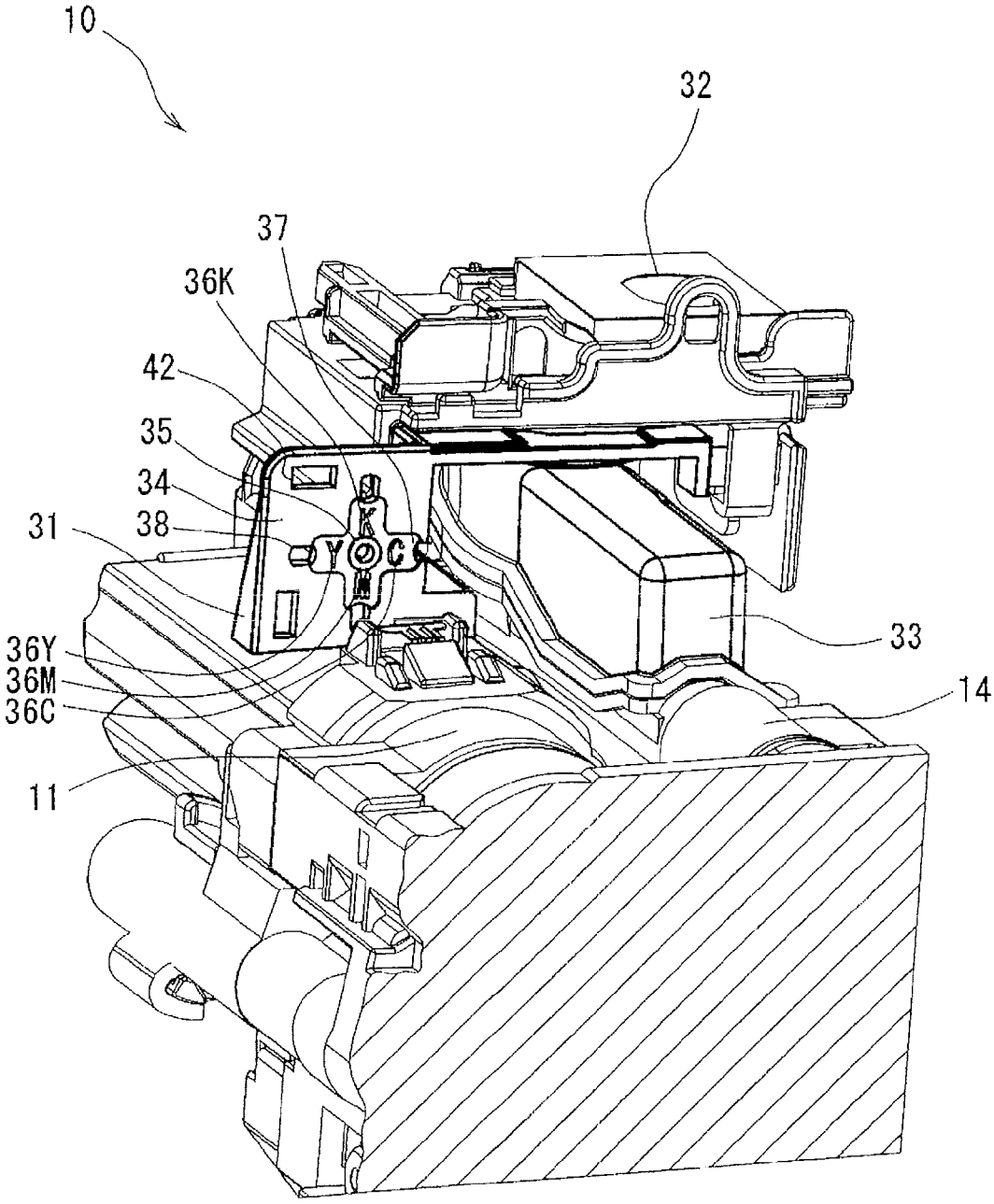
FIG. 4 is an enlarged view of an attached portion and an engagement portion of the side of a developing device as seen from the front end side in an insertion direction of the process cartridge.

As shown in FIG. 4, the attached portion 31 is formed by a thin plate. The attached portion 31 is provided on the upper surface of the photoconductor drum 11 of the process cartridge 10 so as to have an attaching surface 34 which is perpendicular to the insertion direction and opposed to the image forming device body 2. On the attaching surface 34, a rotational shaft joint hole 35 for joining a rotational shaft 30*a* of the incompatible member 30 (to be described later) is formed. According to the present embodiment, the rotational shaft joint hole 35 passes through the thin plate in its thickness direction, however, the rotational shaft joint hole 35 may not pass through the thin plate.

On the respective positions at the same distance and the same angle with the rotational shaft joint hole 35 as a center, identification display portions 36Y, 36M, 36C, and 36K are provided to display the colors of the toners of the process cartridges 10. According to the present embodiment, the identification display portion 36Y is located on the left side in a horizontal direction of the rotational shaft joint hole 35. The identification display portion 36M is located on the lower side in a vertical direction of the rotational shaft joint hole 35. The identification display portion 36C is located on the right side in the horizontal direction of the rotational shaft joint hole 35. The identification display portion 36K is located on the upper side in the vertical direction of the rotational shaft joint hole 35. The identification display portions 36Y, 36M, 36C, and 36K are formed so as to be protruded from the bottom surface of a recess 37 of a cross-like figure that is formed with the rotational shaft joint hole 35 as a center. The surfaces of the identification display portions 36Y, 36M, 36C, and 36K are located on the same plane as the attaching surface 34. The surfaces of the identification display portions 36Y, 36M, 36C, and 36K may be located between the bottom surface of the recess 37 and the attaching surface 34.

Anti-rotation holes 38 are formed adjacent to respective ends in respective directions of a cross of the recess 37 from the rotational shaft joint hole 35. The anti-rotation holes 38 are located at the same distance and the same angle with the rotational shaft joint hole 35 as a center. To each of the anti-rotation holes 38, a projection 39 of the incompatible member 30 (to be described later) is to be joined.

At each apex of a regular tetragon made by four sides being parallel in a horizontal direction and a vertical direction at the same length with the rotational shaft joint hole 35 as a center, a nail engaged hole 42 is formed, to which a nail 41 of an attaching portion 40 of the incompatible member 30 (to be described later) is to be engaged. Four nail engaged holes 42 are not necessarily formed, and the number of the nail engaged holes 42 enough for joining the incompatible member 30 to the attached portion 31 is available. According to the present embodiment, the anti-rotation holes 38 and the nail engaged holes 42 pass through the thin plate in its thickness direction, however, they may not pass through the thin plate.

The toner supply hole 32 is an opening that is formed on the upper surface on the side toward the developing device 14 of the process cartridge 10, and the toner boxes 19 to be fitted to the image forming apparatus 1 are attached to this toner supply hole 32.

Figure 5A:
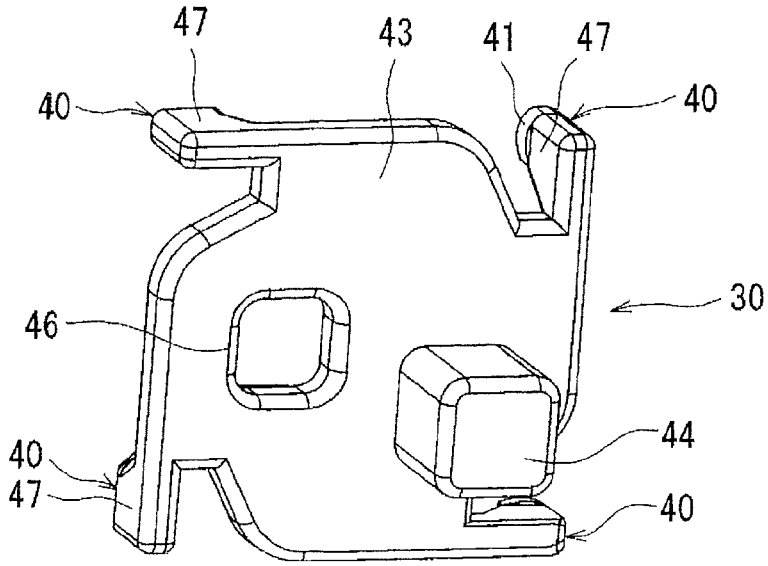
FIG. 5A is a view showing an incompatible member as seen from the side that an attaching projection is protruded.
Figure 5B:
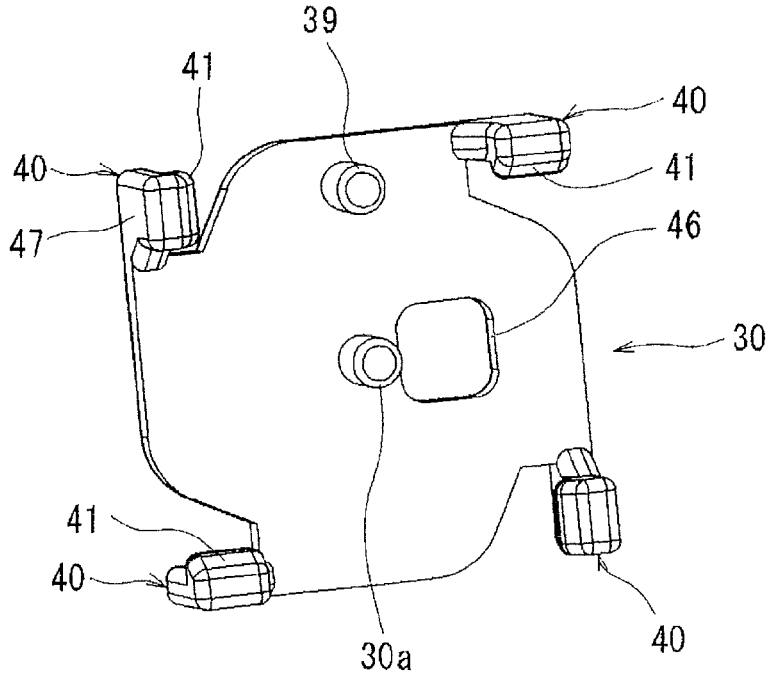
FIG. 5B is a view showing the incompatible member as seen from the opposite side of the side that the attaching projection is protruded.
Figure 6A:
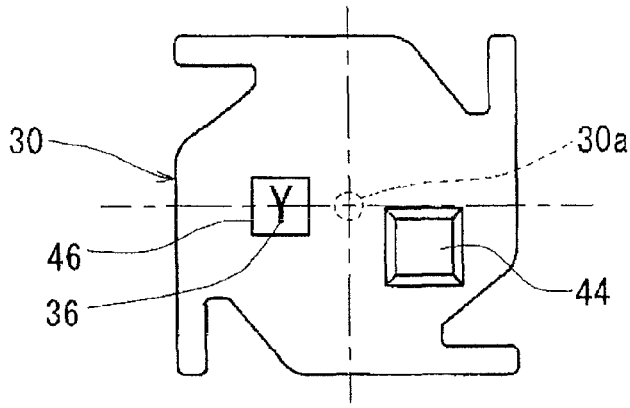
FIGS. 6A to 6D are views showing attaching postures to attach the incompatible members to the attached portions of the process cartridges.
Figure 6B:
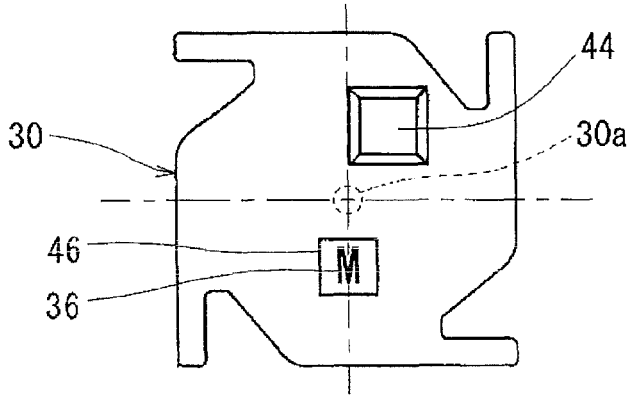
Figure 6C:
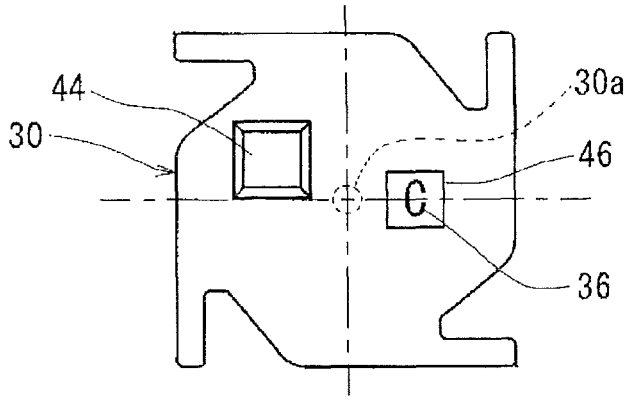
Figure 6D:
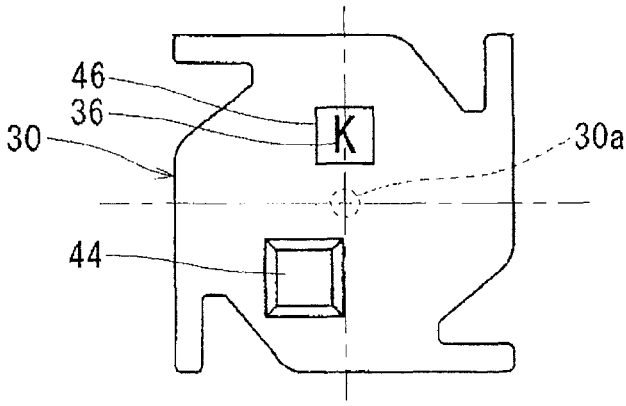

FIGS. 5A and 5B are perspective views of the incompatible member 30. As shown in FIG. 5A, the incompatible member 30 is an approximate regular tetragon. The incompatible member 30 is a rotationally symmetrical shape with the cross-sectional shape in the axial direction being rotationally symmetrical. According to the present embodiment, the incompatible member 30 is formed into a bladed wheel of a wind mill and this incompatible member 30 is formed by a base portion 43 and an attaching portion 40.

The base portion 43 is made by a thin plate with each apex of the approximate regular tetragon being notched. According to the present embodiment, the base portion 43 is formed in a notched shape; however, it may not be formed in the notched shape.

A rotational shaft 30*a* is provided so as to protrude from the thin plate on the position that is a rotational center of the base portion 43. The rotational shaft 30*a* has the length enough to be capable of joined to the rotational shaft joint hole 35 of the attached portion 31.

On the line passing through the rotational shaft 30*a* of the base portion 43 and running parallel to one side of the approximate regular tetragon of the incompatible member 30, a projection 39 so as to protrude in the same direction as the rotational shaft 30*a* is provided. The projection 39 is arranged on a position corresponding to the anti-rotation hole 38 of the attached portion 31 of the process cartridge 10. At least one projection 39 may be provided in the incompatible member 30.

On the base portion 43 on the surface of the side opposite to the side where the rotational shaft 30*a* of the incompatible member 30 is provided, an attaching projection (a photoconductor drum side engagement portion) 44 is provided, which is protruded to the direction opposite to the rotational shaft 30*a*. The position of the rotational shaft 30*a* on the surface being vertical to the axial direction of the rotational shaft 30*a* of the incompatible member 30 is different from the center of the attaching projection 44. Rotating the incompatible member 30 around the rotational shaft 30*a* for each 90 degrees, as shown in FIGS. 6A to 6D, the attaching projection 44 is positioned lower right, upper right, upper left, and lower left based on the rotational shaft 30*a*. The attaching projection 44 has a form corresponding to an acceptance concave portion 45 (to be described later) of the acceptance portion 3 of the image forming apparatus body 2.

On the base portion 43, one displaying hole 46 is formed, which passes through the base portion 43 in its thickness direction in the different position from the rotational shaft 30*a*. In the situation that the incompatible member 30 is attached to the attached portions 31 of the process cartridges 10, identification display portions 36 to display each toner color of plural colors (according to the present embodiment, four colors) within the range where the displaying hole 46 moves can be displayed and identified through the displaying hole 46. The displaying hole 46 is arranged so that only one of the identification display portions 36Y, 36M, 36C, 36K can be displayed. Rotating the incompatible member 30 around the rotational shaft 30*a* for each 90 degrees, the displaying holes 46 are positioned left, under, right, and upper based on the rotational shaft 30*a* as shown in FIGS. 6A to 6D. The displaying holes 46 may have any variations which are capable of identifying the identification display portions 36 and may be notched portions (displaying notched portion).

The attaching portion 40 is provided at each apex of the approximate regular tetragon of the incompatible member 30. In other words, respective attaching portions 40 are arranged at the position rotated around the rotational shaft 30*a* for each 90 degrees.

The attaching portion 40 is formed by an engagement projection portion 47 and a nail 41. The engagement projection portion 47 is provided so as to be protruded in the same direction as the projection direction of the rotational shaft 30*a* of the base portion 43. In other words, the engagement projection portion 47 of the attaching portion 40 is extended in parallel with one side of the approximate regular tetragon from the end portion of the base portion 43 formed in the notched shape and protruded in the same direction as the projection direction of the rotational shaft 30*a*. The nail 41 is provided at the end portion of the engagement projection portion 47 so as to bulge in the orthogonal direction to the projection direction of the engagement projection portion 47. The attaching portion 40 is inserted into the nail engaged hole 42 of the attached portion 31 of the process cartridge 10 so as to be engaged by the nail 41.

The acceptance portion 3 is provided with an insertion port 4 for inserting the process cartridges 10Y, 10M, 10C, and 10K into the inside of the image forming apparatus body 2; a process cartridge containing portion 5 for containing the inserted process cartridges 10Y, 10M, 10C, and 10K; and an acceptance member 6 provided in the vicinity of the side of the insertion port 4. The acceptance member 6 has toner box supporting portions 7Y, 7M, 7C, and 7K for supporting respective color toner boxes (not illustrated) displaced on the upper part thereof and a process cartridge engaged portion 8 displaced on the lower part thereof.

The process cartridge engaged portion 8 is provided with an developing device side engaged portion 48 formed in the shape corresponding to the developing device side engaging portion 33 of each of the process cartridges 10Y, 10M, 10C, and 10K, and the photoconductor drum side engaged portion (the acceptance concave portion) 45 that is formed in the shape corresponding to photoconductor drum side engagement portion (the attaching projection) 44 to accept the attaching projection 44. The developing device side engaged portion 48 is adapted to accept part of the developing device side engaging portion 33 of each of the process cartridges 10Y, 10M, 10C, and 10K by inserting it in the insertion direction. The photoconductor drum side engaged portion 45 is adapted to engage the attaching projection 44; however, the photoconductor drum side engaged portion 45 may accept the attaching projection 44 in a non-contact state. On predetermined positions of the image forming apparatus body 2 to which the process cartridges 10Y, 10M, 10C, and 10K are fitted, the positions of the photoconductor drum side engaged portions 45 of the process cartridge engaged portions 8 are differed respectively corresponding to the positions of the attaching projections 44 of the incompatible members 30 shown in FIGS. 6A to 6D.

Next, the attachment and the function of the incompatible member 30 having the above-described structure will be described. The incompatible member 30 is attached to the attached portion 31 in such a manner that the attaching projection 44 is protruded in the insertion directions that the process cartridges 10Y, 10M, 10C, and 10K are inserted into the image forming apparatus body 2, and the displaying holes 46 are positioned so as to display the color of the toner of the corresponding process cartridge 10. At the beginning, the rotational shaft 30*a* and the projection 39 are inserted into and engaged to the rotational shaft joint hole 35 and the anti-rotation hole 38, respectively. Thereby, it is possible to prevent the rotation of the incompatible member 30 with respect to the attached portion 31 of the incompatible member 30. Then, the engagement projection portion 47 of the attached portion 40 is inserted into the nail engaged hole 42 of the attached portion 31 of each of the process cartridges 10Y, 10M, 10C, and 10K, respectively, and the nail 41 is engaged to the nail engaged hole 42. The engagement of the attached portion 40 into the nail engaged hole 42 is more intense and reliable than the joint between the projection 39 and the anti-rotation hole 38.

Figure 7:
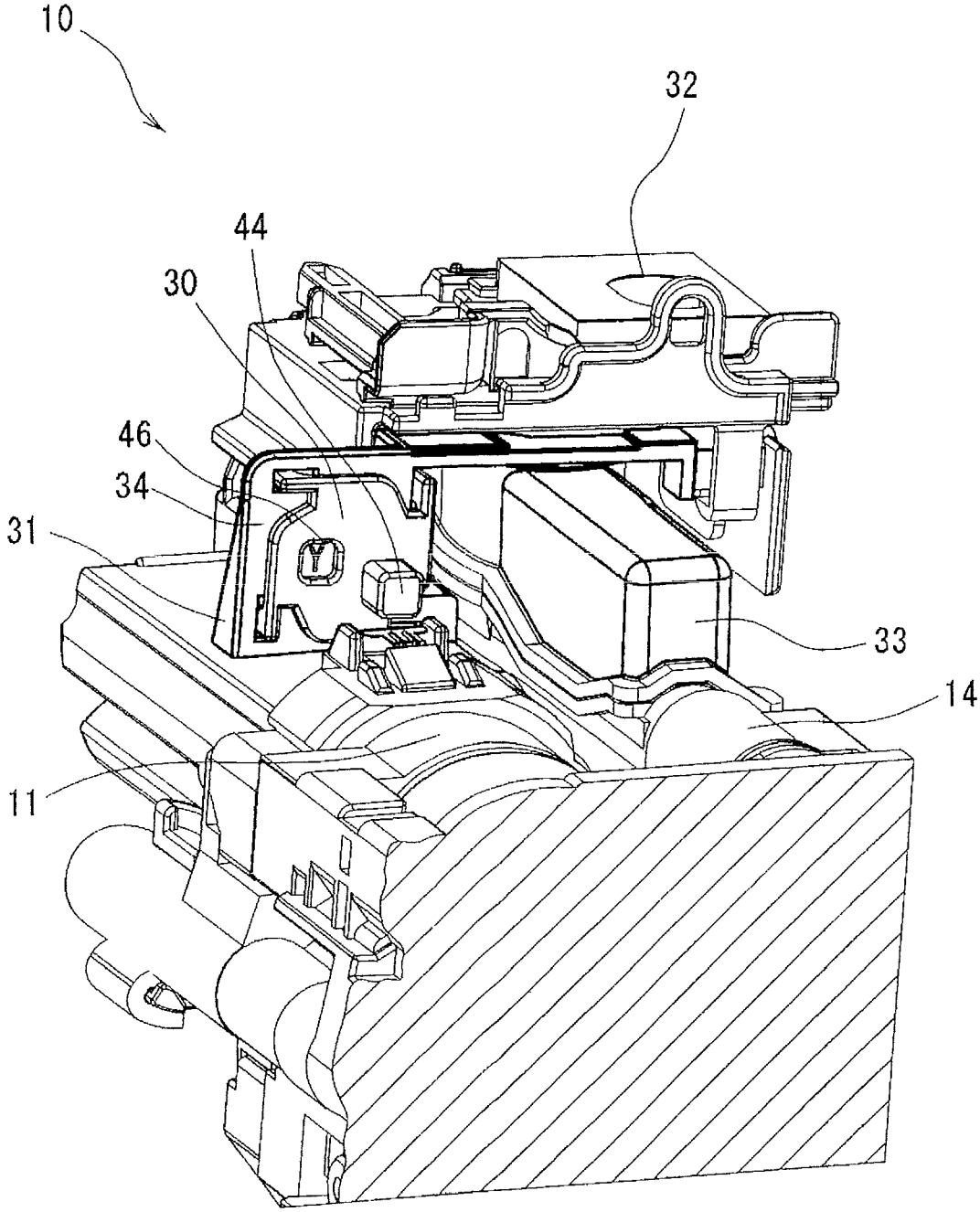
FIG. 7 is a view showing a process cartridge having the incompatible member attached to the attached portion.

FIG. 7 shows the process cartridge 10 having the incompatible member 30 attached to the attached portion 31. The incompatible member 30 is attached so as to be capable of identifying the color of the toner of the process cartridge 10Y for yellow (Y). It is possible to identify the character of Y through the displaying hole 46.

Figure 8:
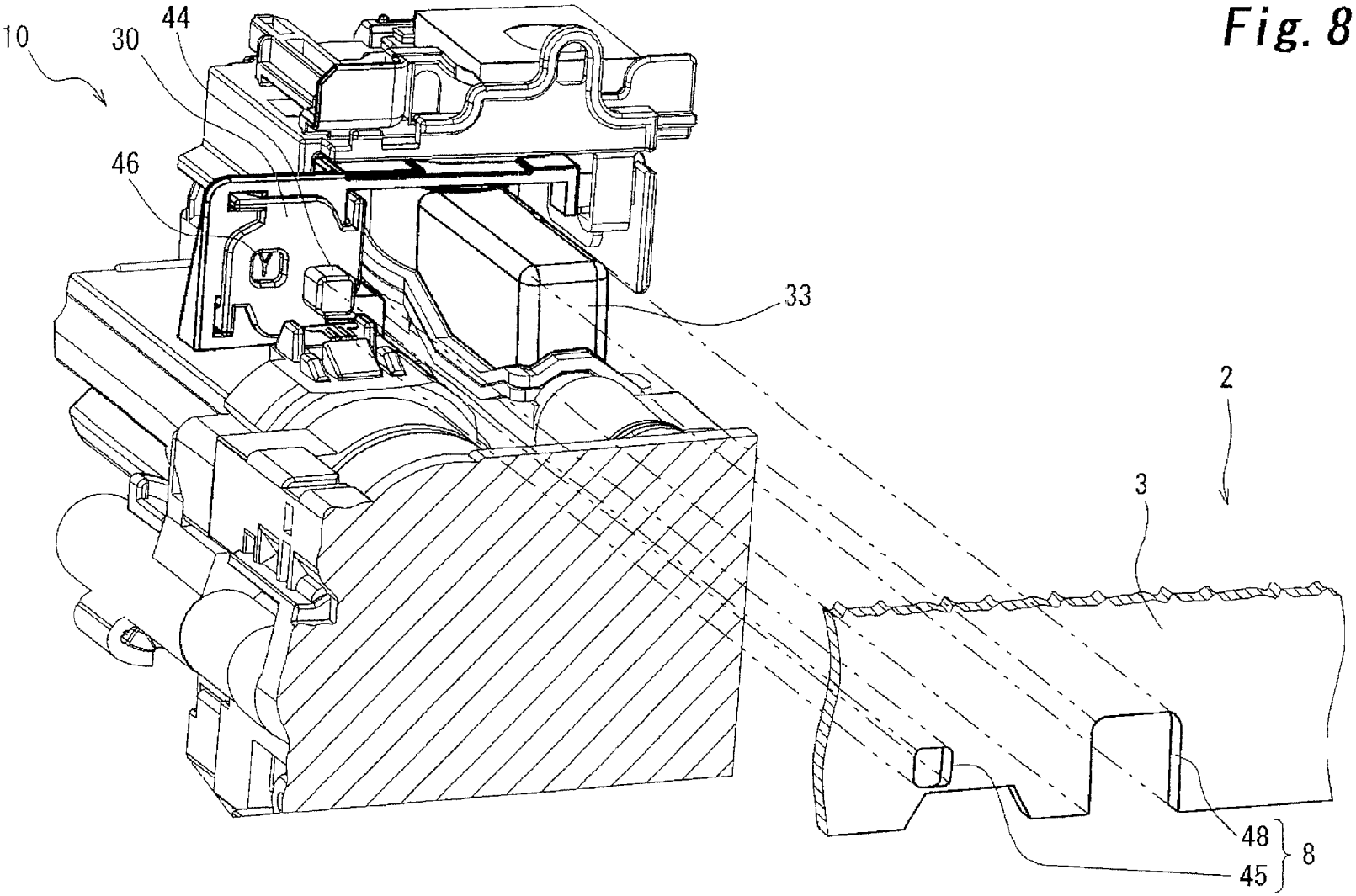
FIG. 8 is a view showing the engagement between the process cartridge having the incompatible member attached thereto and an acceptance portion of the image forming apparatus body.

FIG. 8 shows the engagement between the process cartridge 10 having the incompatible member 30 attached thereto is attached and the process cartridge engaged portion 8 of the acceptance portion 3 of the image forming apparatus body 2. By rotating the attachment posture of the process cartridges 10Y, 10M, 10C, and 10K of the incompatible member 30 to the attached portion 31 around the rotational shaft 30*a* and differing the relative positions to each rotational shaft 30*a* of the attaching projection 44, it is possible to prevent the process cartridges 10Y, 10M, 10C, and 10K from being fitted to the different position from the predetermined position of the image forming apparatus body 2.

Figure 9:
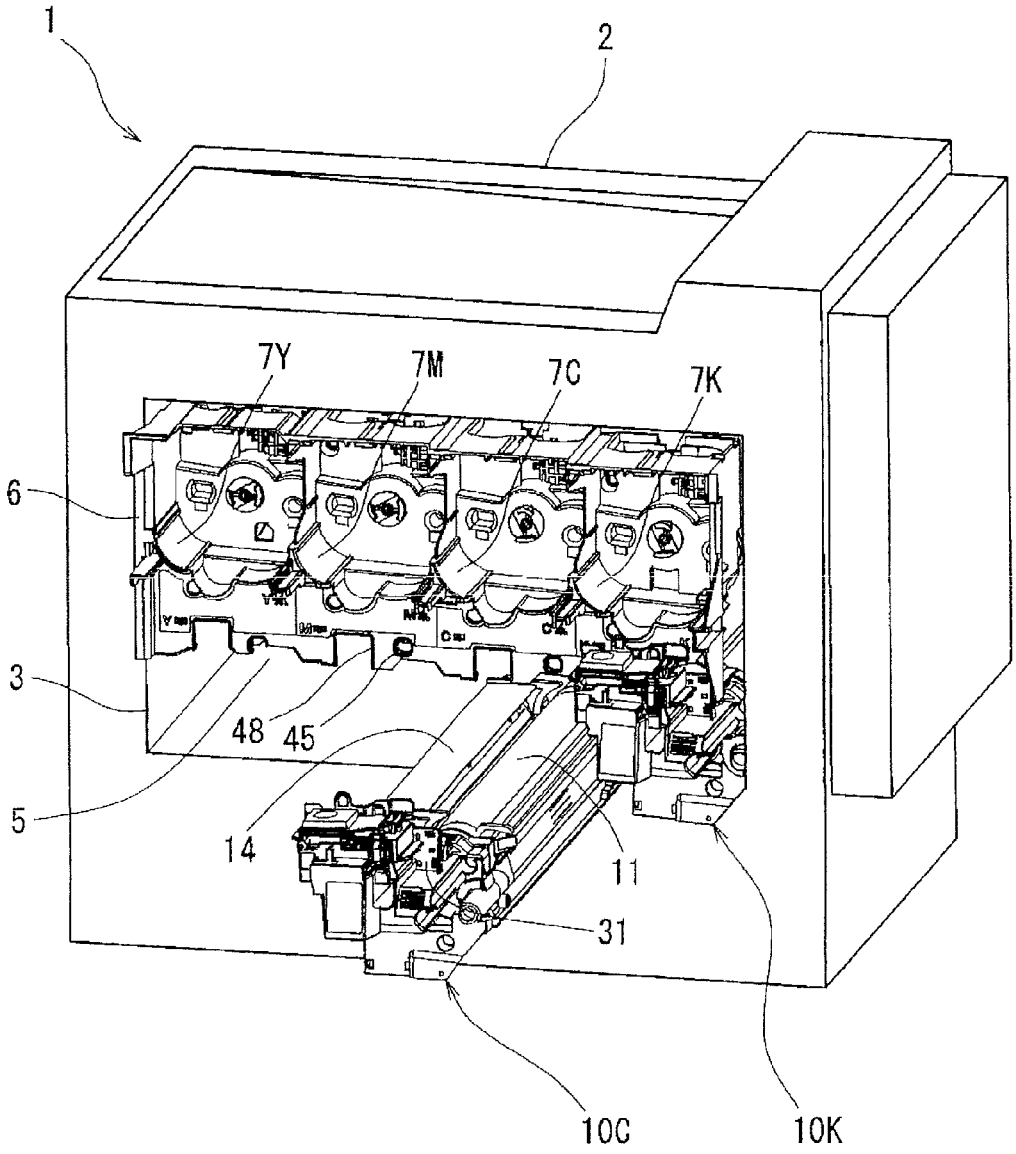
FIG. 9 is a view showing fitting of the process cartridge to the image forming apparatus body.

FIG. 9 shows fitting of the process cartridge 10 to the image forming apparatus body 2. By engaging the front end side engaging portion 29 of the process cartridge 10 to the front end side engaged portion (not illustrated) that is placed in a back side in the insertion direction of the acceptance portion 3 of the image forming device body 2, it is possible to reliably fit the process cartridge 10 to the predetermined position of the image forming device body 2 due to the incompatible fitting structure. In addition, in the case of inserting the process cartridge 10 to the different position from the predetermined position of the image forming device body 2, the process cartridge engaged portion 8 cannot be successfully engaged to the developing device side engaging portion 33 and the attaching projection 44. Therefore, there is no possibility that the process cartridge 10 is fitted to the image forming device body 2 by mistake.

By attaching the incompatible member 30 formed in a rotationally symmetrical shape to the attached portion 31 of the process cartridge 10 while rotating it around the rotational shaft 30*a*, it is possible to change the position of at least one attaching projection 44 of the incompatible member 30 corresponding to each of plural colors. According to the present embodiment, by making the incompatible member 30 into a quadrangle, it is possible to give an incompatibility to the process cartridges 10 for four colors. Then, only on the position where the attaching projection 44 can be accepted by the acceptance concave portion 45 of the acceptance portion 3 of the image forming apparatus body 2, it is possible to carry out incompatible fitting between the process cartridge 10 and the image forming apparatus body 2. By rotating the incompatible member 30 formed in a rotationally symmetrical shape, it is possible to cover the plural colors, so that there is no necessity to provide the incompatible member 30 separately for each of the plural colors. Thereby, the manufacturing cost of the incompatible member 30 can be kept low. In addition, by arranging the identification display portions 36 at the same distance and the same angle with the rotational shaft 30*a* of the incompatible member 30 as a center, it is possible to display the identification display portions 36 of the attached portion 31 of the process cartridge 10 on the position obtained by rotating the incompatible member 30 formed in a rotationally symmetrical shape around the rotational shaft 30*a*. This makes it possible to identify the color of the process cartridge 10 through the displaying hole 46 or the displaying notched portion with the incompatible member 30 attached to the attached portion 31 of the process cartridge 10. At last, it is possible to carry out incompatible fitting between the process cartridge 10 and the image forming apparatus body 2 at a low cost and with a simple structure.

The present invention has been described according to the embodiment heretofore, however, the present invention is not limited to the embodiments and various modifications may be possible. For example, a plurality of attaching projections to the incompatible member 30 may be provided, and a plurality of acceptance concave portions corresponding to the plurality of attaching projections may be provided in the acceptance portion 3 of the image forming apparatus body 2.

On the attached portion 31 of each of the process cartridges 10Y, 10M, 10C, and 10K, without forming the identification display portions 36 being protruded in the recess 37 of a cross-like figure with the rotational shaft joint hole 35 as a center and without providing the recess 37 of a cross-like figure, the identification display portions 36 itself may be formed by the concave portion.

In the case of using six kinds of toners of the image forming apparatus body 2, namely, six kinds of process cartridges 10, providing six identification display portions 36 to the attached portion 31 of the process cartridge 10, the incompatible member 30 may be made into an approximate regular hexagon and the displaying holes 46 may be formed on the position corresponding to the identification display portions 36. The number of postures that can be taken when attaching the incompatible member 30 to the attached portion 31 may be larger than the number of the colors of the toners and the number of the colors to be displayed by the identification display portions 36. For example, in the case of using four kinds of toners, the incompatible member 30 may be made into the approximate regular hexagon that can take six postures. In this case, it is possible to display the color on six places by the identification display portions 36; however, by using four places among them, marks or the like corresponding to these colors may be displayed.

Figure 10:
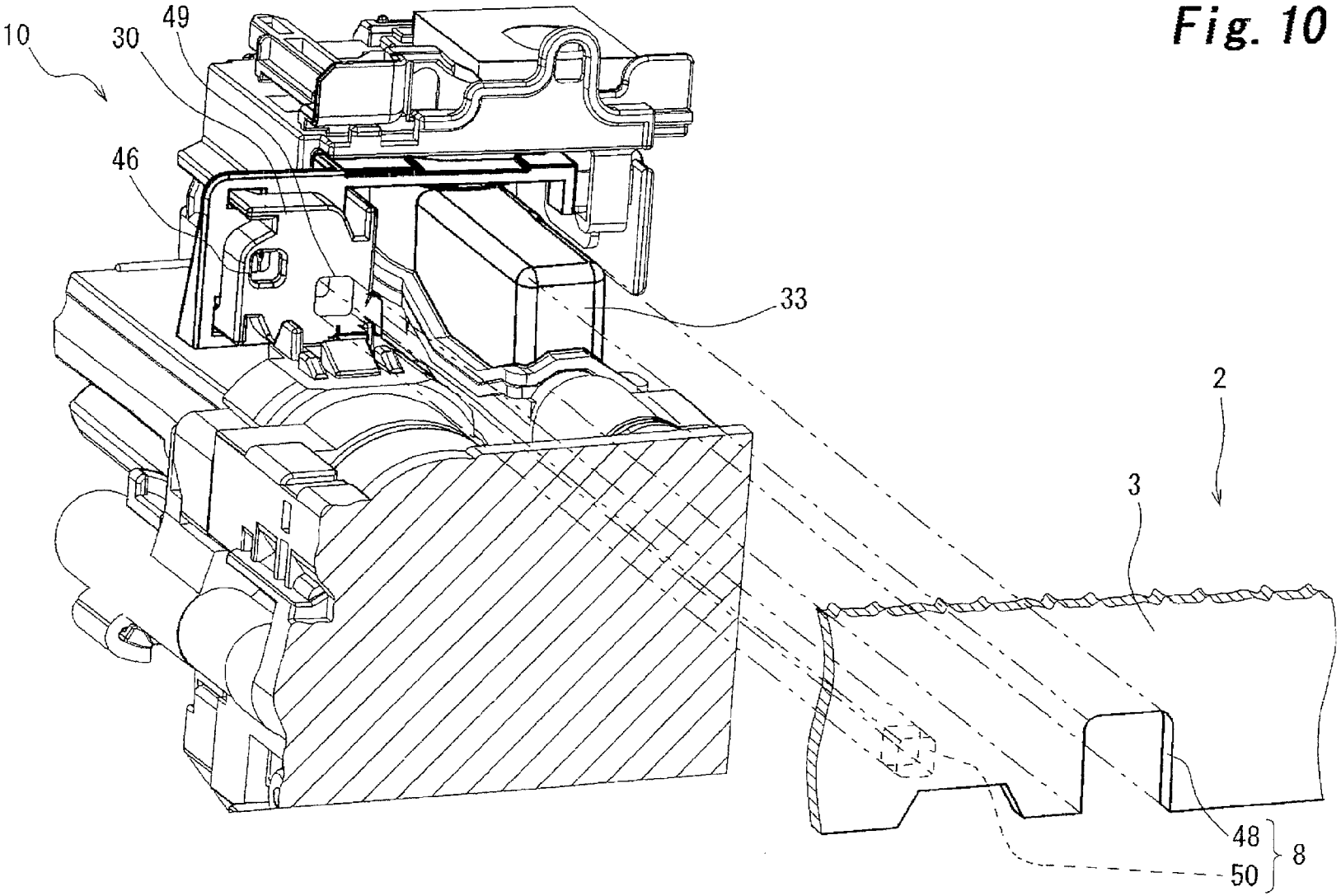
FIG. 10 is a view showing the engagement between the process cartridge having the incompatible member attached thereto and the acceptance portion of the image forming apparatus body.

As shown in FIG. 10, an attaching hole 49 may be formed on the incompatible member 30 with its thickness increased in place of the attaching projection 44, and an insertion convex portion 50 may be provided on the process cartridge engaged portion 8 in place of the acceptance concave portion 45 so that the insertion convex portion 50 is engaged to the attaching hole 49. The attaching hole 49 may be a notched portion (an attaching notched portion). The plurality of attaching holes 49 or the plurality of attaching notched portions may be provided on the incompatible member 30, and insertion convex portions corresponding to the plurality of attaching holes 49 or the plurality of attaching notched portions may be provided on the acceptance portion 3 of the image forming apparatus body 2 so that the plural insertion convex portions may be accepted.

Thus, by attaching the incompatible member 30 formed in a rotationally symmetrical shape to the attached portion 31 of the process cartridge 10 while rotating it around the rotational shaft 30*a*, the position of at least one attaching hole 49 or at least one attaching notched portion of the incompatible member 30 can be changed corresponding to each of the plural colors. Only on the position where the attaching hole 49 or the attaching notched portion can accept the insertion convex portion 50 of the acceptance portion of the image forming apparatus body 2, it is possible to carry out incompatible fitting between the process cartridge 10 and the image forming apparatus body 2. By rotating the incompatible member 30 formed in a rotationally symmetrical shape, it is possible to cover the plural colors, so that there is no necessity to provide the incompatible member 30 separately for each of the plural colors. Thereby, the manufacturing cost of the incompatible member 30 can be kept low. In addition, since the identification display portions 36 for identifying the plural colors on the attached portion 31 of the process cartridge 10 is arranged, it is possible to identify the color of the process cartridge 10 through the displaying holes 46 or the displaying notched portions with the incompatible member 30 attached to the attached portion 31 of the process cartridge 10. At last, it is possible to carry out incompatible fitting between the process cartridge 10 and the image forming apparatus body 2 at the low cost and with the simple structure.

Although the present invention has been fully described byway of the examples with reference to the accompanying drawing, it is to be noted that various changes and modifications will be apparent to those skilled in the art. Therefore, unless such changes and modifications otherwise depart from the spirit and scope of the present invention, they should be construed as being included therein.

What is claimed is:

1. A fitting structure for process cartridges and an image forming apparatus body of an image forming apparatus capable of fitting the process cartridges for plural colors thereto, the fitting structure comprising:

an incompatible member with its cross-sectional shape in an axial direction being rotationally symmetrical, the incompatible member having at least one attaching projection and one displaying hole or one displaying notched portion formed on a position different from a rotational shaft of the rotationally symmetrical shape;

an attached portion of the process cartridge capable of holding the incompatible member with the at least one attaching projection being protruded to the side toward the image forming apparatus body at plural postures being rotated around the rotational shaft, the attached portion having identification display portions for identifying the plural colors arranged on the position corresponding to the displaying hole or the displaying notched portion for each of the plural postures; and an acceptance portion of the image forming apparatus body having an acceptance concave portion for accepting the at least one attaching projection of the incompatible member.

2. The fitting structure according to claim 1, wherein the identification display portions are arranged at the same distance and the same angle with the rotational shaft of the incompatible member as a center.

3. The fitting structure according to claim 2, wherein the incompatible member is a quadrangle.

4. The fitting structure according to claim 1, wherein the incompatible member has an attaching portion arranged at the apex of the rotationally symmetrical shape.

5. An image forming apparatus capable of fitting process cartridges for plural colors thereto, the image forming apparatus having a fitting structure for the process cartridges and an image forming apparatus body, wherein the fitting structure comprising:

an incompatible member with its cross-sectional shape in an axial direction being rotationally symmetrical, the incompatible member having at least one attaching projection and one displaying hole or one displaying notched portion formed on a position different from a rotational shaft of the rotationally symmetrical shape;

an attached portion of the process cartridge capable of holding the incompatible member with the at least one attaching projection being protruded to the side toward the image forming apparatus body at plural postures being rotated around the rotational shaft, the attached portion having identification display portions for identifying the plural colors arranged on the position corresponding to the displaying hole or the displaying notched portion for each of the plural postures; and an acceptance portion of the image forming apparatus body having an acceptance concave portion for accepting the at least one attaching projection of the incompatible member.

6. The image forming apparatus according to claim 5, wherein the identification display portions are arranged at the same distance and the same angle with the rotational shaft of the incompatible member as a center.

7. The image forming apparatus according to claim 6, wherein the incompatible member is a quadrangle.

8. The image forming apparatus according to claim 5, wherein the incompatible member has an attaching portion arranged at the apex of the rotationally symmetrical shape.

9. A fitting structure for process cartridges and an image forming apparatus body of an image forming apparatus capable of fitting the process cartridges for plural colors thereto, the fitting structure comprising:

an incompatible member with its cross-sectional shape in an axial direction being rotationally symmetrical, the incompatible member having at least one attaching hole or at least one attaching notched portion and one displaying hole or one displaying notched portion formed on a position different from a rotational shaft of the rotationally symmetrical shape;

an attached portion of the process cartridge capable of holding the incompatible member at plural postures being rotated around the rotational shaft, the attached portion having identification display portions for identifying the plural colors arranged on the position corresponding to the displaying hole or the displaying notched portion for each of the plural postures; and an acceptance portion of the image forming apparatus body having an insertion convex portion to be inserted into the at least one attaching hole or the at least one attaching notched portion of the incompatible member.

10. The fitting structure according to claim 9, wherein the identification display portions are arranged at the same distance and the same angle with the rotational shaft of the incompatible member as a center.

11. The fitting structure according to claim 10, wherein the incompatible member is a quadrangle.

12. The fitting structure according to claim 9, wherein the incompatible member has an attaching portion arranged at the apex of the rotationally symmetrical shape.

13. An image forming apparatus capable of fitting process cartridges for plural colors thereto, the image forming apparatus having a fitting structure for the process cartridges and an image forming apparatus body, wherein the fitting structure comprising:

an incompatible member with its cross-sectional shape in an axial direction being rotationally symmetrical, the incompatible member having at least one attaching hole or at least one attaching notched portion and one displaying hole or one displaying notched portion formed on a position different from a rotational shaft of the rotationally symmetrical shape;

an attached portion of the process cartridge capable of holding the incompatible member at plural postures being rotated around the rotational shaft, the attached portion having identification display portions for identifying the plural colors arranged on the position corresponding to the displaying hole or the displaying notched portion for each of the plural postures; and an acceptance portion of the image forming apparatus body having an insertion convex portion to be inserted into the at least one attaching hole or the at least one attaching notched portion of the incompatible member.

14. The image forming apparatus according to claim 13, wherein the identification display portions are arranged at the same distance and the same angle with the rotational shaft of the incompatible member as a center.

15. The image forming apparatus according to claim 14, wherein the incompatible member is a quadrangle.

16. The image forming apparatus according to claim 13, wherein the incompatible member has an attaching portion arranged at the apex of the rotationally symmetrical shape.

* * * * *